US007191697B2

(12) United States Patent
Burminskiy

(10) Patent No.: US 7,191,697 B2
(45) Date of Patent: Mar. 20, 2007

(54) PISTON MECHANISM WITH DIVERGING PISTONS

(76) Inventor: Eduard Petrovich Burminskiy, ul. Schepkina, 37/50, Almaty, Kazakhstan (KZ) 480043

( * ) Notice: Subject to any disclaimer, the term of this patent is extended or adjusted under 35 U.S.C. 154(b) by 0 days.

(21) Appl. No.: 10/550,257

(22) PCT Filed: Mar. 11, 2004

(86) PCT No.: PCT/KZ2004/000002

§ 371 (c)(1),
(2), (4) Date: Sep. 22, 2005

(87) PCT Pub. No.: WO2004/085809

PCT Pub. Date: Oct. 7, 2004

(65) Prior Publication Data

US 2006/0180015 A1 Aug. 17, 2006

(30) Foreign Application Priority Data

Mar. 26, 2003 (KZ) ..... 2003/0411

(51) Int. Cl.
*F01B 9/00* (2006.01)
*F02B 25/08* (2006.01)
*F01B 7/12* (2006.01)

(52) U.S. Cl. ..... 92/140; 123/51 A

(58) Field of Classification Search ..... 92/140; 123/51 R, 51 A, 51 B; 417/521
See application file for complete search history.

(56) References Cited

U.S. PATENT DOCUMENTS 1,238,190 A * 8/1917 Pichoud ..... 123/51 A
1,239,274 A * 9/1917 Ingram ..... 123/51 A
1,723,865 A * 8/1929 Kelly ..... 123/51 A
1,835,138 A * 12/1931 Bowman ..... 123/51 A
2,103,103 A * 12/1937 Waters ..... 123/51 A

FOREIGN PATENT DOCUMENTS

DE 32 37 858 1 A1 4/1984
DE 41 35 386 A1 3/1992
DE 195 03 444 C1 5/1996

* cited by examiner

*Primary Examiner*—Thomas E. Lazo
(74) *Attorney, Agent, or Firm*—McCormick, Paulding & Huber LLP

(57) ABSTRACT

A piston mechanism comprises a crankcase, a crankshaft with three crankpins, a cylinder with diverging pistons defining working chambers having inlet and outlet openings, and two connecting members, one of which cooperates with the middle crankpin and the other with the two outer crankpins. In the body of the cylinder there are guide channels provided, in which connecting rods are arranged in alternating sequence, which are attached to one or the other connecting member by their bases, forming two synchronous groups of connecting rods. The guide channels are provided with through-cuts in the working surface of the cylinder with outlets into its cavity so that the faces of the connecting rods of the synchronous groups facing the cavity of the cylinder form movable parts of its working surface. The pistons are attached by their peripheries to the lateral faces of the connecting rods of one or the other synchronous group sequentially and spaced from each other, forming two movable rigid carcasses inserted in one another, moving in opposite directions.

46 Claims, 5 Drawing Sheets

66
68
44
68
45
5
25
13
15
16
6
26
1
19
20
12
5
25
17
11
18
6
26
10
5
25
2
43
35
42
34
3
36
28
27
30
58
57
63
49
4
54
64
65
48
66
15
6
12
5
20
19
18
11
6
26
10
5
25
35
34
27
43
30
42
36
28
58
57
63
49
53
48
7
54
65
65
64

PISTON MECHANISM WITH DIVERGING PISTONS

CROSS REFERENCE TO RELATED APPLICATIONS

This application is entitled to the benefit of and incorporates by reference essential subject matter disclosed in International Patent Application No. PCT/KZ2004/000002 filed on Mar. 11, 2004 and Kazakhstan Patent Application No. 2003/0411.1 filed Mar. 26, 2003.

FIELD OF THE INVENTION

The invention relates to machine engineering, particularly to piston mechanisms for direct transformation of energy of a working fluid (gas or steam) into mechanical energy or re-transformation of mechanical energy into the energy of a working fluid, and can be utilized in the construction and manufacturing of engines, compressors, hydraulic buffers and the like.

BACKGROUND OF THE INVENTION

A two-stroke engine is known having divergent pistons, the inventor of which is the applicant of the present application, which piston mechanism comprises a cylinder in which pistons are arranged opposite each other, forming working chambers, the pistons being joined by two pairs of rods in two groups having an opposite direction of movement. Pistons of one of the directions of movement are firmly attached on each pair of rods and spaced from one another, alternating with pistons of the opposite direction of movement. The rods of one group of pistons run through the pistons of the other group and vice versa. These rods cooperate with three crankpins of a crankshaft via links. Two outer rods for the pistons of one direction of movement are joined with two outer crankpins, while two inner rods for the pistons of the opposite direction of movement are joined with a middle crankpin (see German application DE 3237858, Class F 01B 3/00, F 04B 27/00, 1984 r.).

The advantage of said piston mechanism lies in its ability to increase the effectiveness of its work by a provision of working chambers from both sides of each piston, which allows a twofold increase of the effective capacity, and also by the connection of the rods with three crankpins of the crankshaft, which allows the pistons of the same direction to work synchronized and parallel to one another.

However, a major shortcoming of this design is the problem of sealing the rods in the regions where they run through the pistons of the opposite direction of movement. A lack of effective sealing results in leakage of the working chambers and decreases the reliability of the piston mechanism as a whole. Moreover the cross movement of the rods and pistons taking place in this arrangement increases the wear of the cylinder walls and disrupts the evenness of the piston movement, which is disadvantageous for the working characteristics of the piston mechanism.

A two-stroke engine having divergent pistons is known, the inventor of which is identical with the applicant of the present invention, wherein two opposite cylinders are arranged along a common axis. The piston mechanism of each cylinder comprises two divergent pistons acting on a common crankshaft directly by power elements (connecting rods). The crankshaft comprises two basis pins and three crankpins, the two pistons adjacent to the crankshaft acting on the middle crankpin and the two pistons spaced from the crankshaft acting on the two outer ones. The pistons of the same direction of movement adjacent to the crankshaft are firmly attached to one another by a hinge guiding a slide bar joined to the middle crankpin. The pistons spaced from the crankshaft are joined to the outer crankpins by links (see German patent DE 4135386, Class F 02B 75/28, 75/32, 1992 r.).

The advantage of this technical solution is the replacement of rods by power elements—connecting rods and a slide bar directly acting on the crankshaft and outside the borders of the working cavity of the cylinder. Thus it becomes possible to house a second piston in each cylinder. This exchange of the piston rods of one direction in favour of connecting rods makes it possible to seal the joint of the cylinder-piston system. The suggested two-stroke engine is characterised by its compactness, low weight of the construction, the possibility to use multiple cylinders and low manufacturing costs.

The disadvantage of said two-stroke engine having divergent pistons is its marked friction of the hinge, which necessitates a frequent exchange.

A two-stroke engine with divergent pistons is known having a piston mechanism comprising opposite cylinders with a stepped inner cavity having inlet and outlet openings and two pistons meeting each other in each of them, and a crankshaft with three crankpins. Both outer crankpins are joined with a sliding sleeve (an outer connecting member) by a link, wherein the sliding sleeve slides through the cylinder body like on a guide rail and is joined with the pistons spaced from the crankshaft by a synchronised group of connecting rods. These connecting rods are arranged so that they can move back and forth in guiding channels arranged in the cylinder body parallel to its axis. The middle crankpin is joined to the pistons adjacent to the crankshaft through at least one link and an internal connecting member. The internal connecting member is disposed in the cavity of the cylinder and is integral with the pistons with apertures for the crankshaft to pass through and move freely (see patent DE 19503444, F 02B 75/32, F 02B 25/10, 1998).

The advantage of said known piston mechanism is that the piston rods of one direction of movement are replaced by a group of connecting rods moving in synchronicity together with one connecting member in one case, and the connection of the pistons of the opposite direction of movement directly with the other connecting member, allowing a linear synchronous movement of the pistons in both cylinders in another case. By linking the connecting members and the crankshaft, the wear of the connecting hinge mechanism and the basic bearings lessens. In any position, the crankshaft is only loaded with the differing force of both resultants, the periodically activated forces of gas and mass on the inner and outer crankpins of the crankshaft. This positive effect multiplies as the number of revolutions of the engine increases.

A disadvantage of said technical solution lies in the different types of the outer and inner connecting members, which makes the design more complex and increases the dimensions and the weight of the mechanism while the kinetic connection of the pistons with the connecting members is difficult. The construction must be manufactured with great exactness. The problem of arranging more than two diverging pistons in one cylinder remains unsolved to date.

BRIEF SUMMARY OF THE INVENTION

The task which the present invention intends to solve is to create a new piston mechanism which is efficient, reliably working, simple in manufacturing and having a wide range of applications, and which contains little metal and is low in costs. Other objectives and advantages of the present invention will become evident from the description and drawings.

The technical result is an increase of the specific capacity of the piston mechanism by arranging a number of diverging pistons in one cylinder, which form working chambers between them, in which different strokes of independent working cycles are carried out simultaneously.

The task is solved in that in the piston mechanism with divergent pistons comprises a crankcase with a crankshaft, a cylinder with inlet and outlet openings and at least two pistons directed in opposite directions, and connecting members cooperating with three crankpins of the crankshaft, wherein one of the connecting members is joined to the middle crankpin and the other is joined to the two outer crankpins, wherein at least one piston is firmly attached to connecting rods, the bases of which are firmly attached to one of the connecting members and located in guiding channels arranged in the cylinder body parallel to its axis, forming a synchronous group of connecting rods with a direction of movement corresponding to said connecting member, wherein the cylinder additionally comprises connecting rods which are firmly attached to at least one oppositely directed piston, while their bases are firmly attached to another connecting member, and which are located in additional guide channels formed in the cylinder body parallel to the known guide channels in alternating sequence, forming another synchronous group of connecting rods having a direction of movement corresponding to the other connecting member, wherein all guide channels are arranged with through-cuts in the working surface of the cylinder with outlets into its cavity so that lateral faces of the connecting rods of the synchronous groups of different directions facing the cavity of the cylinder form moving parts of its working surface, wherein the pistons are sequentially fastened by their periphery at the lateral faces of the connecting rods of the different synchronous groups forming working chambers between them, and the connecting members are located between the crankshaft and the piston adjacent to it; the connecting members are provided in the shape of the inner and, with a central opening, the outer connecting members, which can freely move in one another so that the outline of the inner connecting member repeats the outline of the central opening of the outer connecting member; the inner connecting member is provided in the shape of two plates attached to one another, the lower one with a stand and the upper one with radial cuts around the periphery for the connecting rod of the synchronous group of said connecting member, which are attached to the lower plate by their bases, and with recesses between said connecting rods in both plates for the connecting rod of the other synchronous group; the outer connecting member has the shape of two multi-lateral plates with an oval form attached to one another at their tops with central apertures, wherein the lower one with two diametric stands and the upper one with radial cuts following the outline of the central aperture for the connecting rod of the synchronous group of said connecting member, attached to the lower plate by their bases, and with recesses between said connecting rods in both plates for the connecting rod of the other synchronous group; the inner connecting member is joined to the middle crankpin of the crankshaft; the outer connecting member is joined to two outer crankpins of the crankshaft; the inner connecting member is joined to the middle crankpin of the crankshaft via a central crank-hinge frame; the outer connecting member is joined to two outer crankpins of the crankshaft via lateral crank-hinge frames; the crank-hinge frames are each made in the form of a separated rectangular outline with a stand and a slide bar disposed in the outline for free translational movement, holding a corresponding crankpin of the crankshaft; the stand of the central crank-hinge frame is joined with the stand of the inner connecting member through a pin; each of the stands of the lateral crank-hinge frames is joined with the corresponding stand of the outer connecting member via a pin; the crank-hinge frames are disposed between guiding plates arranged in the crankcase; the inner connecting member is joined to the middle crankpin of the crankshaft via the central link; the outer connecting member is joined to the outer crankpins of the crankshaft via the lateral links; the central link is joined to the inner connecting member via a pin; each of the lateral links is joined to the corresponding stand of the outer connecting member via a pin; on the lateral faces of the connecting rods of the synchronous group of the inner connecting member facing the cylinder cavity three protrusions for attaching the pistons of one direction of movement are formed; on the lateral faces of the connecting rods of the synchronous group of the outer connecting member facing the cylinder cavity two protrusions for attaching the pistons of the opposite direction of movement are formed; the protrusions on the connecting rods of the synchronous group of the outer connecting member are disposed between the protrusions on the connecting rods of the synchronous group of the inner connecting member; the protrusions on the connecting rods of one synchronous group are disposed at equal distances from one another which is equal to the distance between the protrusions on the connecting rods of the other synchronous group; the protrusions on the connecting rods of both synchronous groups are widening, the area of their cross section increasing; on the wide faces of the connecting rods of both synchronous groups from the side of their lateral faces disposed furthest away from the cylinder axis there are shoulders for the guide channels; the shoulders are formed continuously; the shoulders are interrupted; the widths of the wide faces of the connecting rods of both synchronous groups in a radial direction, not considering the shoulders, exceeds the thickness of the connecting rods by no less than two times; the cross section of the connecting rods corresponds to the cross section of the guide channels; the connecting rods are arranged in the guide channels having a gap of less than 0.02 mm; the pistons have annular engaging grooves for the protrusions of the connecting rod of the synchronous groups; the pistons have annular grooves for the sealing rings; the pistons are shortened; the pistons are additionally attached to the protrusions of the connecting rods of both synchronous groups by bolts; the guide channels for the connecting rods of both synchronous groups cover the entire length of the working cylinder; the guide channels for the connecting rods of the synchronous groups are shortened; the guide channels have a T-shaped cross section profile; the guide channels for the connecting rods of the different synchronous groups alternate with each other by one guide channel; the guide channels for the connecting rods of the different synchronous groups alternate with each other by two guide channels; in the cylinder body at equal distances from one another the guide channels are formed; the through-cuts in the guide channels cover their entire lengths; the inlet and outlet openings are disposed in central cross sections of the working chambers formed by two diverging pistons; the working chambers formed by the diverging pistons have the same height; the working chamber formed by one outer piston has a height which is two times smaller than the working chambers formed by the diverging pistons; the inlet and outlet openings are disposed in the upper part of the working chamber formed by one outer piston; the inlet and outlet openings are arranged in spaces between the guide channels; the cylinder has an adjustable lid disposed in the crankcase; the crankcase has technical apertures; the cylinder has a lid; the cylinder has spark plugs in the working chambers.

The claimed invention differs from the most pertinent prior art in that the cylinder additionally comprises connecting rods which are firmly attached to at least one piston moving in the opposite direction, and their bases are attached to the other connecting member, and are disposed in additional guide channels formed in the cylinder body parallel to the known guide channels in alternating sequence, forming a synchronous group of connecting rods of the other connecting member, wherein all guide channels have through-cuts in the working surface of the cylinder with outlets into its cavity so that the lateral faces of the connecting rods of the synchronous groups of different directions facing the cavity of the cylinder form movable parts of its working surface, wherein the pistons are sequentially attached by their peripheries to the lateral faces of the connecting rods of the different synchronous groups forming working chambers between them.

Each of these features is essential, and taken together they are sufficient for solving the pertinent task.

The arrangement of the connecting members between the crankshaft and the piston adjacent thereto; the connecting members being provided as an inner, and, with a central opening, an outer connecting member for free movement within one another so that the outline of the inner connecting member repeats the outline of the central opening of the outer connecting member; the inner connecting member having the form of two plates attached to one another, the lower one with a stand and the upper one with radial cuts around the periphery for the connecting rod of the synchronous group of said connecting member, attached to the lower plate by their bases and having recesses between these connecting rods in both plates for the connecting rod of the other synchronous group; the outer connecting member having the form of two multi-sided plates being rounded to an oval at their tops and attached to one another with central openings, the lower one with two diametric stands and the upper one with radial cuts following the outline of the central opening for the connecting rod of the synchronous group of said connecting member attached on the lower plate by their bases, and having recesses between said connecting rods in both plates for the connecting rod of the other synchronous group; connecting the inner connecting member with the middle crankpin of the crankshaft; connecting the outer connecting member with two outer crankpins of the crankshaft; connecting the inner connecting member with a middle crankpin of the crankshaft through a central crank-hinge frame; connecting the outer connecting member with the outer crankpins of the crankshaft through lateral crank-hinge frames; the crank-hinge frames each having the form of a separated rectangular outline with a stand and with a slide bar disposed within the outline for free translational movement which holds the corresponding crankpin of the crankshaft; connecting the stand of the central crank-hinge frame with the stand of the inner connecting member via a pin; connecting each of the stands of the lateral crank-hinge frames with the corresponding stand of the outer connecting member via a pin; disposing the crank-hinge frames between the guide plates disposed in the crankcase; connecting the inner connecting member with the middle crankpin of the crankshaft via a central link; connecting the outer connecting member with the outer crankpins of the crankshaft via lateral links; connecting the central link with the stand of the inner connecting member via a pin; connecting each of the lateral links with the corresponding stand of the outer connecting member via a pin; arranging three protrusions for attaching the pistons of one direction of movement on the connecting rods of the synchronous group of the inner connecting member on the lateral faces, facing the cylinder cavity; arranging two protrusions for attaching the pistons of the opposite direction of movement on the connecting rods of the synchronous group of the outer connecting member on the lateral faces, facing the cylinder cavity; arranging the protrusions on the connecting rods of the synchronous group of the outer connecting member between the protrusions on the connecting rods of the synchronous group of the inner connecting member; arranging the protrusions on the connecting rods of one synchronous group at equal distances from one another and equal distances between the protrusions on the connecting rods of the other synchronous group; widening the protrusions on the connecting rods of both synchronous groups so that the area of their cross section is enlarged; providing both synchronous groups on the wide faces from the side of their lateral faces which are furthest away from the cylinder axis with shoulders for the guide channels; making the shoulders continuous; making the shoulders interrupted; the width of the wide faces of the connecting rods of both synchronous groups in a radial direction exceeding the thickness of the connecting rods by no less than two times without considering the shoulders; correspondence of the cross section of the connecting rods to the cross section of the guide channels; arrangement of the connecting rod in the guide channels with a gap of less than 0.02 mm; providing the pistons with annular engaging grooves for the protrusions of the connecting rods of the synchronous groups; providing the pistons with annular grooves for the sealing rings; shortening the pistons; additionally securing the pistons on the protrusions of the connecting rods of both synchronous groups by bolts; arranging the guide channels for the connecting rods of both synchronous groups over the entire length of the working cylinder; shortening the guide channels for the connecting rods of the synchronous groups; the guide channels having a T-shaped cross section profile; alternation of the guide channels with each other for the connecting rods of the different synchronous groups by one guide channel; alternation of the guide channels with each other for the connecting rods of the different synchronous groups by two guide channels; forming the guide channels in the cylinder body at equal distances from one another; arranging through-cuts in the guide channels along their entire length; disposing the inlet and outlet openings in the central sections of the working chambers formed by two diverging pistons; equal height with respect to each other of the working chambers formed by the diverging pistons; making the working chamber formed by one outer piston two times smaller in height than the working chambers formed by the diverging pistons; disposing the inlet and outlet openings in the upper part of the working chamber formed by one outer piston; disposing the inlet and outlet openings in spaces between the guide channels; providing the cylinder with an adjustable lid disposed in the crankcase; providing the crankcase with technical apertures; providing the cylinder with a lid; providing the cylinder with spark plugs in the working chambers are the features characterising the proposed invention in special embodiments.

The presence of the additional connecting rods which are firmly attached to at least one oppositely directed piston, and are firmly attached to the other connecting member by their bases, allows to create another synchronous group of connecting rods of the opposite direction of movement, which is identical with the known synchronous group of connecting rods, which allows the use of equal parts and a simplification of their manufacture while the possibilities of kinetic connections of the pistons with the connecting members are increased.

The arrangement of the additional connecting rods in the additional guide channels disposed in the cylinder body parallel to the known guide channels in an alternating manner allows the disposal of a second synchronous group of connecting rods of opposite direction of movement exactly like the known group of connecting rods and to lessen an overload of the working cavity of the cylinder, which allows a simplification of the design of the piston mechanism, a reduction of its dimensions and a more efficient use of the working cavity of the cylinder.

Providing all guide channels with through-cuts in the working surface of the cylinder with outlets into its cavity allows a disposal of the connecting rods of both synchronous groups in the guide channels so that their lateral faces facing the cylinder cavity form movable parts of its working surface with an opposite direction of movement, which allows a firm attachment of the pistons immediately by their peripheries with the movable parts of the working surface of the cylinder. Such an attachment of the pistons of both directions of movement by their peripheries does away with all restrictions concerning their arrangement in one cylinder in the necessary number.

The sequential arrangement of the pistons on the synchronous connecting rods of the different groups does away with restrictions concerning the arrangement of working chambers in the necessary number in one cylinder between diverging pistons, which simultaneously carry out different strokes of independent working cycles.

The complete claimed features make it possible to obtain a piston mechanism characterised by its increased specific capacity, low weight, compactness, simple design and construction, low manufacturing costs, increased reliability, long work life, and with a greater range of applications.

BRIEF DESCRIPTION OF THE DRAWINGS

The essential features of the present invention will become clear from the following description making reference to the accompanying drawings.

DETAILED DESCRIPTION OF THE INVENTION

One embodiment is chosen as the preferred one of the proposed piston mechanism for the example of a four-stroke internal combustion engine (ICE).

Figure 2:
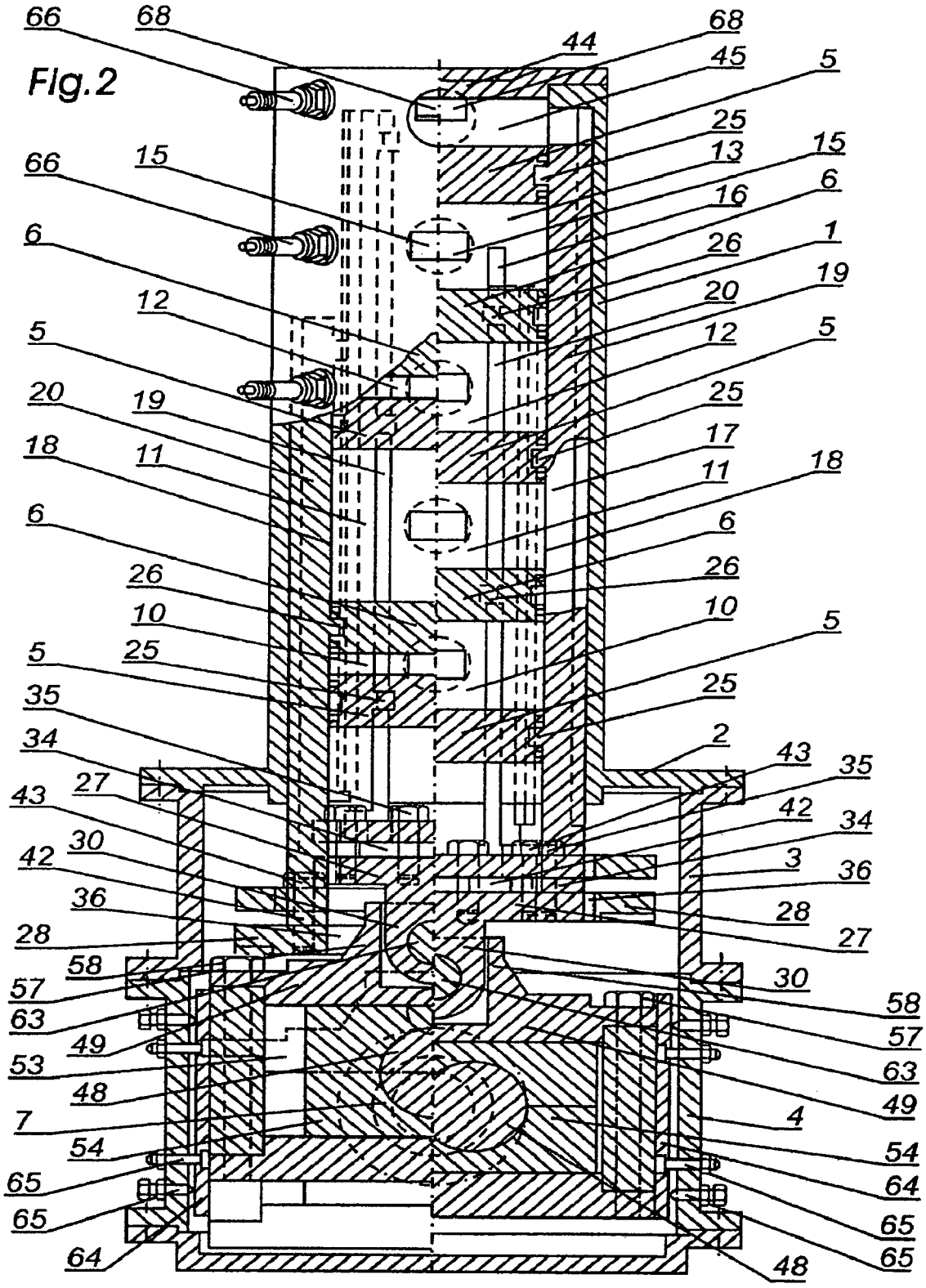
FIG. 2 is a longitudinal sectional view in the plane 2—2 of FIG. 1, on the left of the axis: the position of the pistons analogous to the position of the pistons on the left of the axis in FIG. 1, on the right of the axis: one stroke later.
Figure 3:
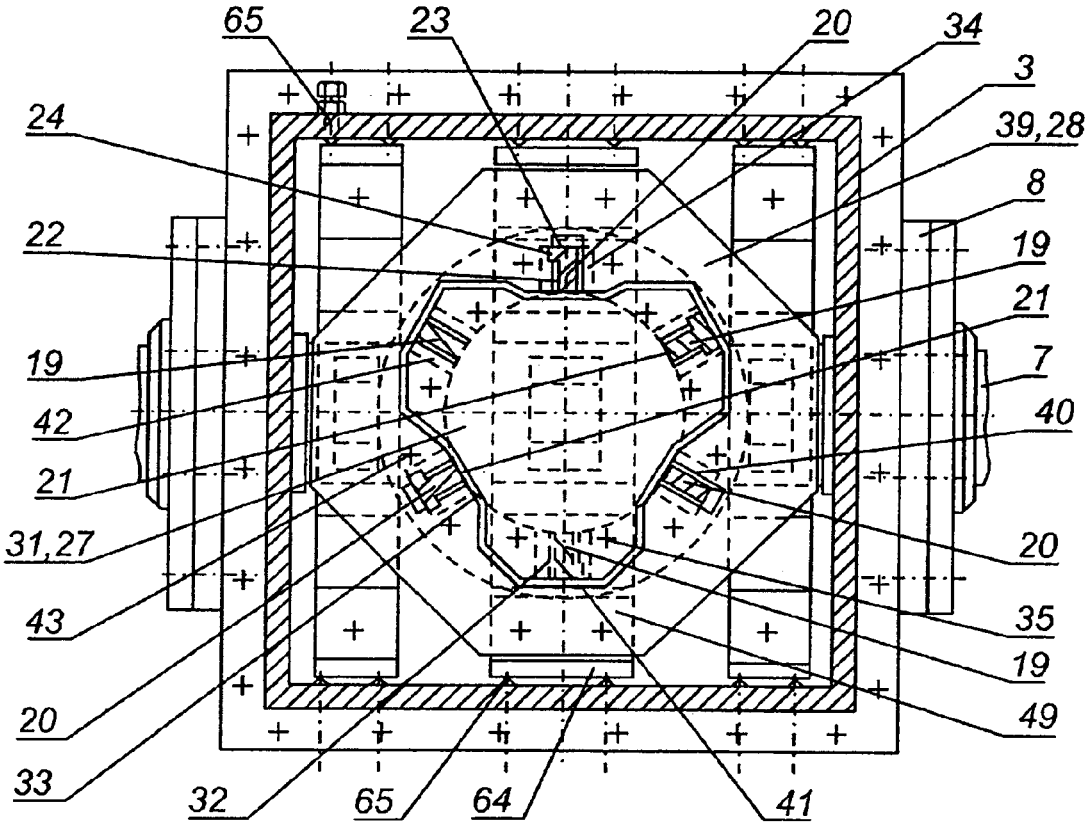
FIG. 3 is a cross sectional view in the plane 3—3 of FIG. 1.
Figure 4:
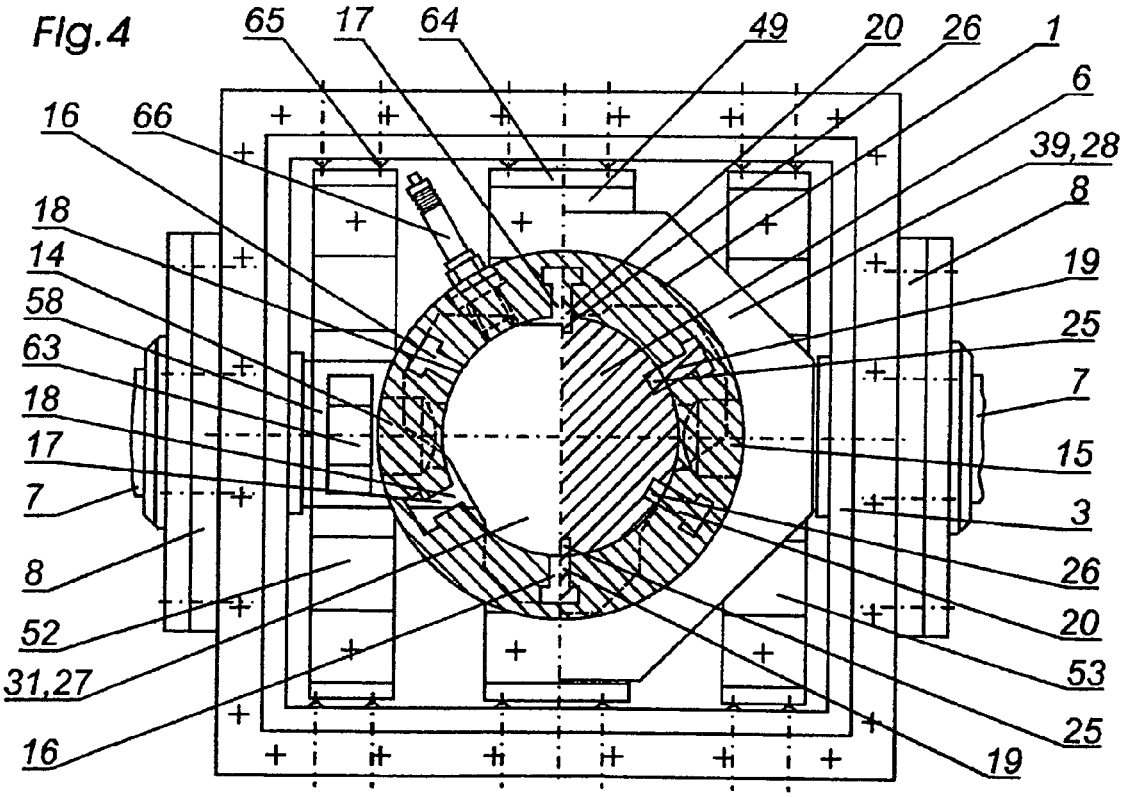
FIG. 4 is a cross sectional view in the plane 4—4 of FIG. 1 with the adjustable lid removed, on the left of the axis: with the connecting rods, pistons and outer connecting member removed, on the right of the axis: with the inner connecting member removed.
Figure 5:
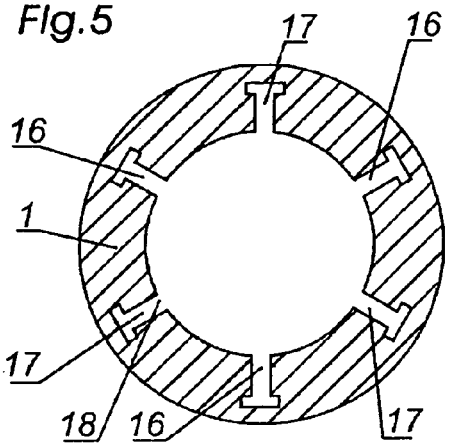
FIG. 5 is a cross sectional view of the cylinder of the piston mechanism.
Figure 6:
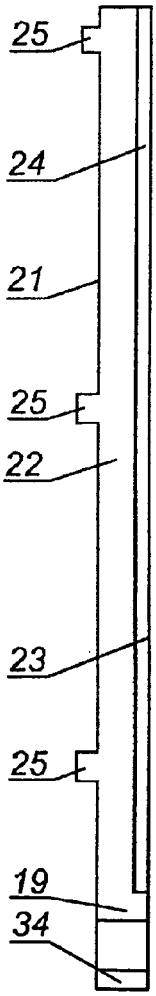
FIG. 6 is a side view of a connecting rod of a synchronous group of connecting rods, firmly attached to the inner connecting member.
Figure 7:
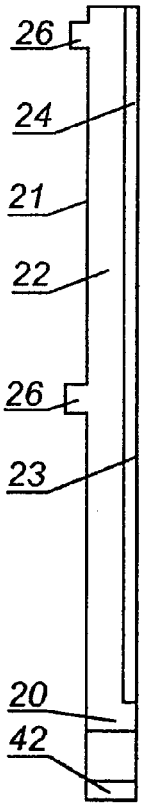
FIG. 7 is a side view of a connecting rod of a synchronous group of connecting rods, firmly attached to the outer connecting member.

The piston mechanism (ICE) (see FIG. 1) comprises a cylinder 1 with an adjustable lid 2 attached on a removable insert 3 arranged in a crankcase 4. Pistons 5, 6 are arranged in the cylinder 1, while in the crankcase 4 a crankshaft 7 is arranged disposed in bearing assemblies 8 on bearings 9. Three pistons 5 and two pistons 6 form working chambers 10, 11, 12, 13 between them with inlet 14 and outlet 15 openings (see FIG. 2, 4) in the cross section of each of them. In the body of the cylinder 1 (see FIG. 5) two groups of guide channels 16, 17 are arranged evenly in a circle parallel to its axis, with three channels in each group. The guide channels 16, 17 alternate with one another. The guide channels 16, 17 are provided over their entire length with through-cuts 18 in the working surface of the cylinder 1 with outlets into its cavity. The guide channels 16, 17 have a T-shaped cross sectional profile. In the guide channels 16 connecting rods 19 are disposed (see FIG. 3) for translational movement, and in the guide channels 17, connecting rods 20 are disposed in the same way. Each of the connecting rods 19, 20 faces the cavity of the cylinder 1 by its narrow lateral side 21 (see FIG. 6, 7) having the profile of the working surface of the cylinder 1 so that the lateral sides 21 of all connecting rods 19, 20 form movable parts of its working surface. The narrow connecting rods 19, 20, having sufficient width in the radial direction, can withstand high axial loads. They have sufficient flexibility in the cross direction enabling them to be arranged in the long guide channels 16, 17 with a gap of less than 0.02 mm providing the necessary seal of the working chambers. To maintain the cylindrical configuration of the working surface of the cylinder 1 in the movable parts providing a smooth transition of its the movable parts to the non-movable ones, shoulders 24 are formed on the wide lateral faces 22 of each of the connecting rods 19, 20 from the side of the lateral face 23 which is furthest away from the axis of the cylinder 1 for the profile of the guide channels 16, 17 preventing radial displacement of said connecting rods. The width of the lateral faces 22 of the connecting rods 19, 20 without considering the shoulders 24 exceeds their thickness by no less than two times. On the lateral faces 21 of each connecting rod 19 (see FIG. 6) three protrusions 25 of different height from its lower end are arranged for attaching three pistons 5, each around its periphery, on all connecting rods 19 on the corresponding level. On the lateral face 21 (see FIG. 7) of each connecting rod 20 two protrusions 26 are arranged having different heights from its lower end for attaching two pistons 6, each around its periphery, on all connecting rods 20 at the corresponding level. The distances between the protrusions 25, 26 of each connecting rod 19, 20 are equal to one another. The protrusions 26 of the connecting rods 20 are arranged between the protrusions 25 of the connecting rods 19 and take up a central position between them when the pistons 6 are located in a middle position between the corresponding pistons 5 (see FIG. 2).

Figure 15:
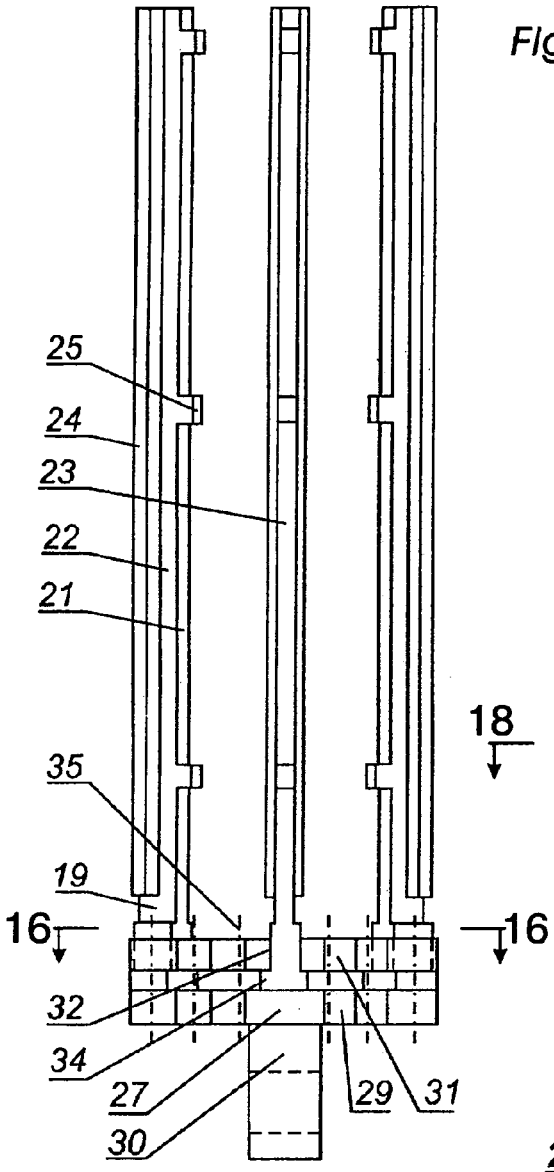
FIG. 15 is a side view of the inner connecting member in assembled state with connecting rods of a corresponding synchronous group.
Figure 17:
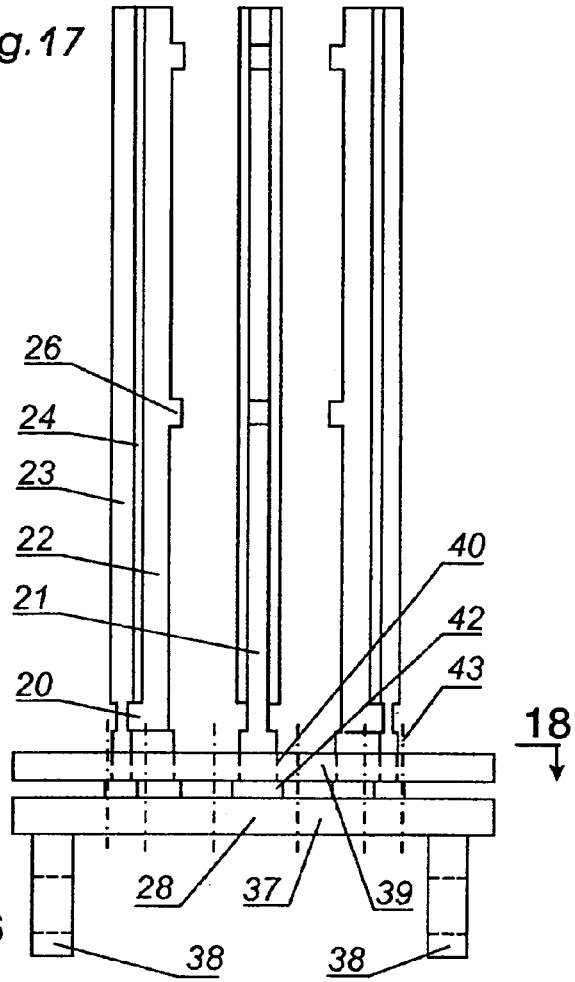
FIG. 17 is a side view of the outer connecting member in assembled state with connecting rods of a corresponding synchronous group.
Figure 16:
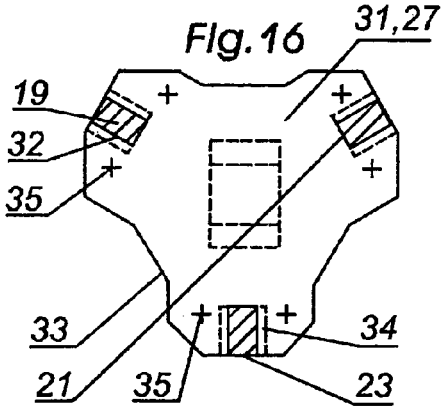
FIG. 16 is a cross sectional view in the plane 16-16 in FIG. 15.
Figure 18:
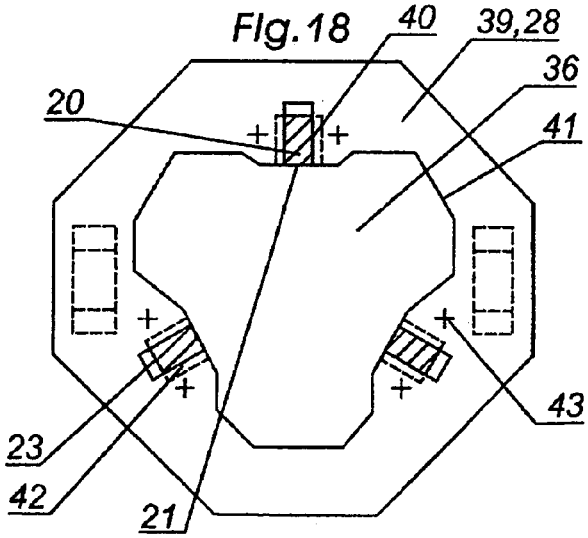
FIG. 18 is a cross sectional view in the plane 18—18 in FIG. 17.

The lower bases of the connecting rods 19 are firmly attached to the inner connecting member 27 (see FIG. 15, 16) forming one synchronous group of connecting rods 19, and the lower bases of the connecting rods 20 are firmly attached to the outer connecting member 28 (see FIG. 17, 18) forming the other synchronous group of connecting rods 20. The inner connecting member 27 and the outer connecting member 28 (see FIG. 3) are arranged for free movement in each other so that the inner outline of the outer connecting member 28 repeats the outline of the inner connecting member 27. They are disposed between the cylinder 1 and the crankshaft 7 (see FIG. 1, 2).

The inner connecting member 27 (see FIG. 15, 16) has the form of two plates attached to one another, the lower one 29 with a stand 30 and the upper one 31 with radial cuts 32 around the periphery for the connecting rod 19 and with recesses 33 between them in both plates for the connecting rod 20. The connecting rods 19 are arranged with their bases on the lower plate 29. Their securing grips 34 are engaged between the plates 29, 31 by bolts 35.

The outer connecting member 28 (see FIG. 17, 18) has the form of two multi-sided plates formed into an oval at their tops and attached to one another with central openings 36, the lower one 37 of them with two diametric stands 38 and the upper one 39 with radial cuts 40 following the outline of the central opening 36 for the connecting rod 20 of the synchronous group of this connecting member and with recesses 41 between these connecting rods in both plates for the connecting rod 19 of the other synchronous group. The connecting rods 20 are positioned on the lower plate 37 by their bases. Their securing grips 42 are engaged between the plates 37, 39 by bolts 43.

When arranging the connecting members 27, 28 in one plane (see FIG. 2 to the right of the axis), the basic working chambers 10, 11, 12, 13 are equal to each other in height. The upper piston 5 forms an additional chamber 45 with the lid 44 of the cylinder 1, the height of which is equal to half the height of the basic working chambers 10, 11, 12, 13 with the same position of the connecting members 27, 28, when the connecting members 27, 28 are installed on one level.

Figure 13:
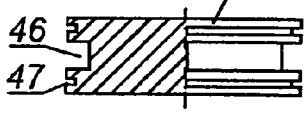
FIG. 13 is a side view of the piston, on the left of the axis: in longitudinal section.

On the peripheries of the lateral surfaces of the pistons 5, 6 (see FIG. 13) there are annular engaging grooves 46 by which the pistons 5, 6 are attached firmly with pressure to the protrusions 25, 26 corresponding to the connecting rods 19, 20. The attachment of each of the pistons 5, 6 on three synchronous connecting rods 19 or 20 by their peripheries firmly stabilizes their vertical position and decreases the load on each connecting rod threefold. Such attachment allows a radial widening of the pistons 5, 6 displacing them along the corresponding protrusions 25, 26 when they are heated and returning them into their initial position when they cool down. On the side face of the pistons 5, 6 around their peripheries on both sides from the annular engaging grooves 46, annular grooves 47 are formed for sealing rings.

Figure 8:
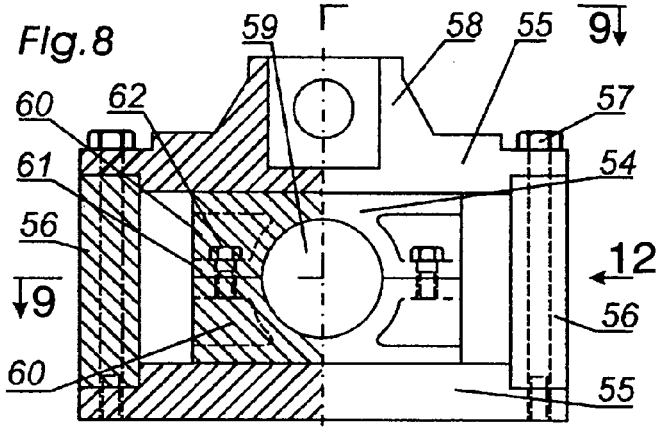
FIG. 8 is a front view of the middle crank-hinge frame in an assembled state, on the left of the axis: in longitudinal section.
Figure 9:
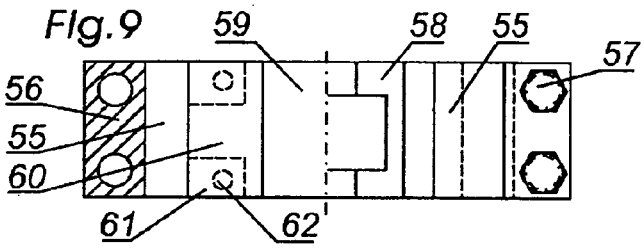
FIG. 9 is a view in the plane 9—9 in FIG. 8, on the left of the axis: in cross section.
Figure 12:
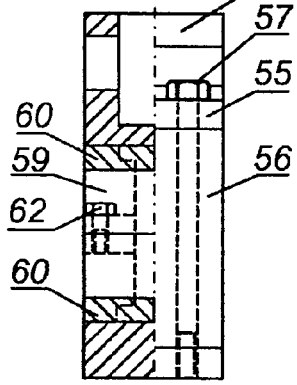
FIG. 12 is a view from the end of the crank-hinge frame in the direction of arrow 12 shown in FIG. 8, on the left of the axis: in longitudinal view.

The inner connecting member 27 is joined with a middle crankpin 48 (see FIG. 1) of the crankshaft 7 through a central crank-hinge frame 49, and the outer connecting member 28 is joined with outer crankpins 50, 51 of the crankshaft 7 through lateral crank-hinge frames 52, 53. The central crank-hinge frame 49 is analogous to the lateral crank-hinge frames 52, 53 and differs from them only by its reinforced structure since it is designed for a double load. Each of the crank-hinge frames 49, 52, 53 (see FIGS. 8, 9, 12) is a frame having a respective slide bar 54 arranged inside in the form of two cross bars 55 arranged on two supports 56 with the aid of two coupling bolts 57. The upper cross bar 55 has a stand 58 in its middle portion from the side of the cylinder 1. Each slide bar 54 is a thick rectangular apertured plate with a central opening 59 for one of the crankpins 48, 50, 51 of the crankshaft 7. Both constructive parts 60 of each slide bar 54 have protrusions 61 for securing said parts with one another by bolts 62 together at the corresponding crankpin 48, 50, 51.

The stand 58 of the central crank-hinge frame 49 is pivotally joined to the stand 30 by a pin 63 (see FIG. 2), which stand 30 is provided in the middle portion of the lower plate 29 of the inner connecting member 27. The stands 58 of the lateral crank-hinge frames 52, 53 are each pivotally joined by the pins 63 to one of two diametric stands 38 on the lower plate 37 of the outer connecting member 28. Thus, the middle crankpin 48 of the crankshaft 7 is joined to the inner connecting member 27 by the central crank-hinge frame 49, while two outer crankpins 50, 51 are joined to the outer connecting member 28 by the lateral crank-hinge frames 52, 53. In such a kinetic joint the crank-hinge frames 49, 52, 53 have a free rotating stage around the corresponding pin 63 in any position of the crankshaft 7. Stability of their position is obtained by guide plates 64 (see FIG. 2) and the regulating bolts 65 disposed in the crankcase 4. On the walls of the cylinder 1 in the cross sections of the working chambers 10, 11, 12, 13, spark plugs 66 are disposed. Under the lid 44 of the cylinder 1 in the additional working chamber 45, inlet and outlet openings 67 resp. 68 are provided and a spark plug 66 is disposed (see FIG. 2).

In a not presented embodiment of the invention there is a variation of the opposite disposal of the cylinders 1. In this embodiment the crank-hinge frames 49, 52, 53 are provided with two oppositely arranged stands 58, which joined from two sides to the connecting members 27, 28 of the oppositely arranged cylinders 1. The number of oppositely arranged cylinders 1 depends on the required capacity of the internal combustion engine.

In possible embodiments of the piston mechanism the overall number of pistons 5, 6 can equal two or more.

There can be two or more synchronous connecting rods 19, 20 in each group. The number of guide channels 16, 17 is defined in accordance with the number of connecting rods 19, 20.

The connecting rods of the different synchronous groups 19, 20 can alternate with each other by one connecting rod or more. The guide channels 16, 17 are provided for the corresponding connecting rods 19, 20.

Figure 10:
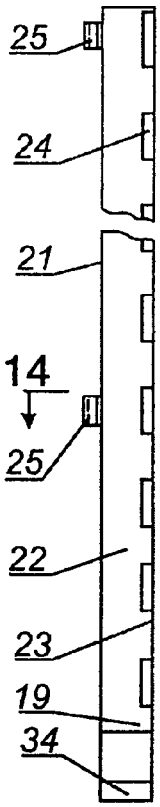
FIG. 10 is a side view of a connecting rod of a synchronous group of connecting rods, firmly attached to the inner connecting member, a variant of the connecting rod with widening protrusions and interrupted shoulders.
Figure 11:
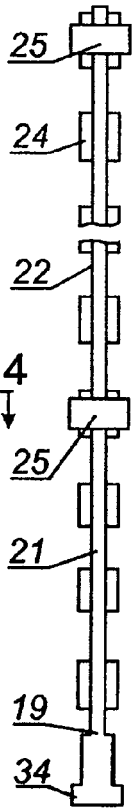
FIG. 11 is a front view of the connecting rod of FIG. 10.
Figure 14:
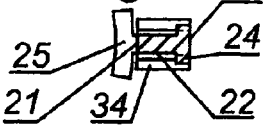
FIG. 14 is a cross sectional view in the plane 14—14 in FIG. 10.

The connecting rods 19 can be provided with widening protrusions 25 (see FIGS. 10, 11, 14) having a greater width, with a more evenly distribution of forces on them along their height and along the line where they are joined to the connecting rods 19. The connecting rods 20 are provided in an analogous manner.

Figure 1:
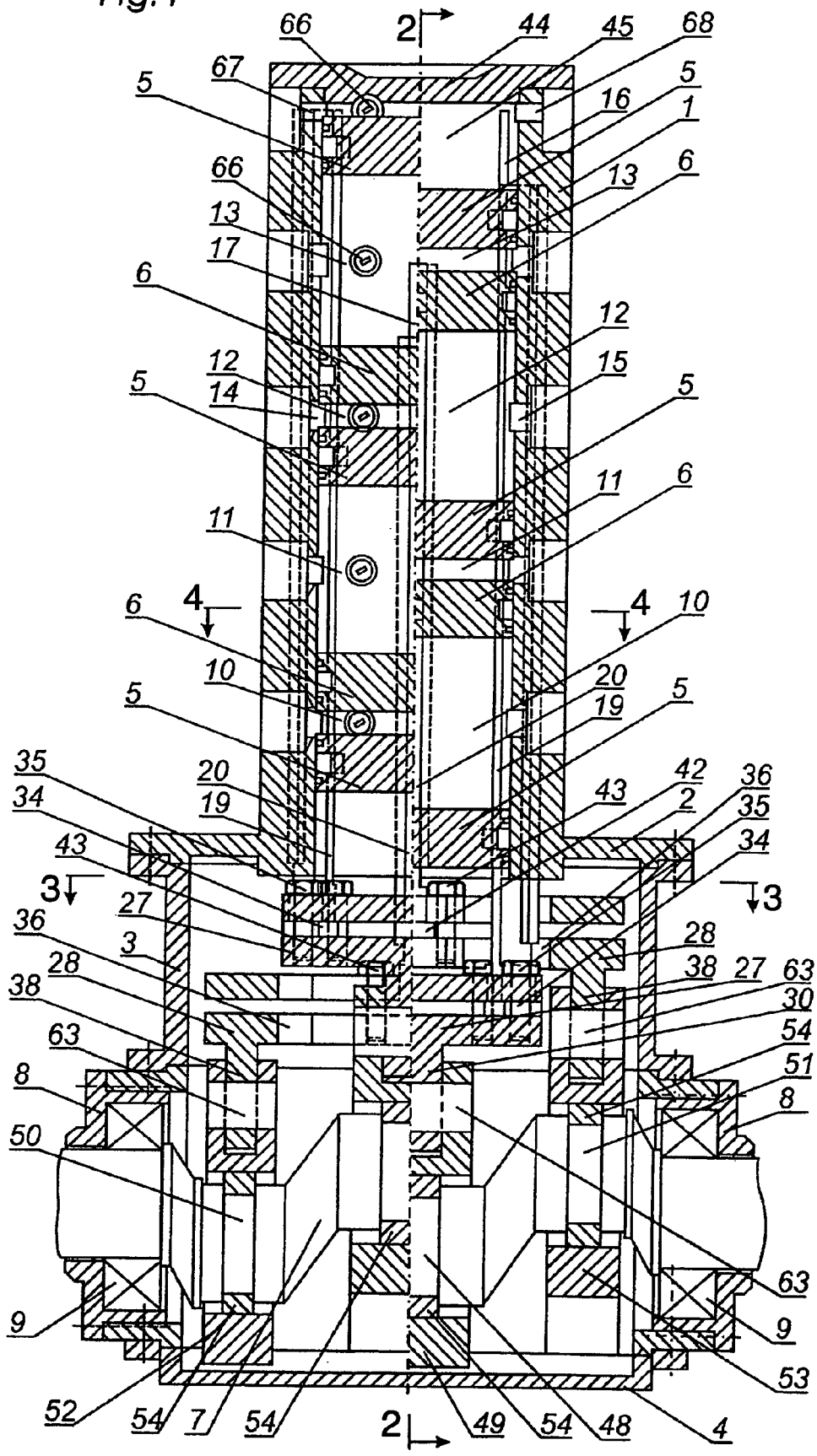
FIG. 1 is a longitudinal sectional view of the piston mechanism, on the left of the axis: the pistons of one and the other synchronous groups of connecting rods at maximum displacement along the axis in opposite directions and being at opposite dead centers, and on the right of the axis: the same, one stroke later, according to the present invention.

The guide channels 16, 17 can be shortened for limiting the movement of the corresponding connecting rods 19, 20 (see FIG. 1).

The connecting rods 19 can be provided with interrupted shoulders 24 with a corresponding increase of their flexibility. The connecting rods 20 are provided in an analogous manner.

The connecting members 27, 28 can be joined with the corresponding crankpins 48, 50, 51 of the crankshaft 7 by links.

The pistons 5, 6 can be additionally attached to the protrusions of the corresponding connecting rods by bolts.

The action of the above described embodiment of the piston mechanism for the example of a four-stroke ICE evidently shows the wide range of possibilities of the proposed invention. In the system of a four-stroke ICE an independent working cycle is repeated continuously in each working chamber 10, 11, 12, 13, including the sequence of the four strokes: The first stroke is the working stroke, the second stroke is the outlet stroke, the third stroke is the inlet stroke, the fourth stroke is the compression stroke involving a determined mass of working fluid (a fuel mix or combustion products). The initial state of the working chambers 10, 11, 12, 13 (see FIG. 1 to the left of the axis) is such that all chambers are prepared so that the following strokes can be completed therein simultaneously: A working stroke in working chamber 10, a compression stroke in working chamber 11, an inlet stroke in working chamber 12, an outlet stroke in working chamber 13, which pertain to independent working cycles of the corresponding working chambers, displaced by one stroke per working chamber in the indicated sequence.

In the initial state the working chamber 10 is filled with compressed fuel mix, and when high voltage is energized on the spark plug 66 disposed in said chamber, the fuel mix combusts. An increase of the pressure in the working chamber 10 during burning of the fuel mix results in a stepwise movement of the pistons 5, 6 in opposite directions, transferring force from them onto the crankpins 48, 50, 51 of the crankshaft 7. This force is transferred through corresponding groups of synchronous connecting rods 19, 20, the connecting members 27, 28, the crank-hinge frames 49, 52, 53 and the slide bars 54. The synchronous group of connecting rods 19, 20 move in the guide channels 16, 17 in opposite directions. As a result, in the working chamber 10 a working operation is completed. The crankshaft 7 does a half revolution, the first stroke (working operation) of a full working cycle of the working chamber 10 is completed. Simultaneously in the working chambers 11, 12, 13 the following strokes are completed, respectively: The fourth stroke (compression) in the working chamber 11, the third stroke (inlet) in the working chamber 12, the second stroke (outlet) in the working chamber 13 of a full working cycle of each of said chambers. The pistons 5, 6 (see FIG. 1 to the right of the axis) are in opposite positions in the working cylinder 1. The basic working chambers 10, 11, 12, 13 are, respectively, prepared for the completion of the following strokes: Outlet (second stroke) in working chamber 10, working operation (first stroke) in working chamber 11, compression (fourth stroke) in working chamber 12, inlet (third stroke) in working chamber 13.

In this situation the compressed fuel mix fills the working chamber 11, and after high voltage is energized on the spark plug 66 disposed in said chamber, a combustion of the fuel mix takes place therein in an analogous manner, and the working operation is completed. The crankshaft 7 does another half revolution, the first stroke (working operation) of the full working cycle of chamber 11 is completed. Simultaneously in the working chambers 12, 13, 10 the following strokes are completed, respectively: The fourth stroke (compression) in working chamber 12, the third stroke (inlet) in working chamber 13, the second stroke (outlet) in working chamber 10, of a full working cycle of each of said chambers. The pistons 5, 6 (see FIG. 1 to the left of the axis) occupy their initial position in the working cylinder 1. As a result, the basic working chambers 10, 11, 12, 13 are prepared for, respectively, the completion of the following strokes: Inlet (third stroke) in working chamber 10, outlet (second stroke) in working chamber 11, working operation (first stroke) in working chamber 12, compression (fourth stroke) in working chamber 13.

In this situation the compressed fuel mix fills the working chamber 12, and a working operation is completed therein in an analogous manner with a corresponding turn of the crankshaft 7 by another half revolution. The first stroke (working operation) of a full working cycle of the working chamber 12 is completed. Simultaneously, in the working chambers 13, 10, 11 the following strokes are completed, respectively: The fourth stroke (compression) in working chamber 13, the third stroke (inlet) in working chamber 10, the second stroke (outlet) in working chamber 11, of a full working cycle of each of said chambers. The pistons 5, 6 (see FIG. 1 to the right of the axis) again occupy a position opposite to their initial position in the cylinder 1. The working chambers 10, 11, 12, 13 are, respectively, prepared for the completion of the following strokes: Compression (fourth stroke) in working chamber 10, inlet (third stroke) in working chamber 11, outlet (second stroke) in working chamber 12, working operation (first stroke) in working chamber 13.

In this situation the working chamber 13 is filled with compressed fuel mix. After completion of the working operation therein in an analogous manner with a corresponding turn of the crankshaft 7 by another half revolution, the first stroke (working operation) of the full working cycle of chamber 13 is completed. Simultaneously, in the working chambers 10, 11, 12 the following strokes are completed, respectively: The fourth stroke (compression) in working chamber 10, the third stroke (inlet) in working chamber 11, the second stroke (outlet) in working chamber 12, of a full working cycle of each of said chambers. As a result, after the sequential completion of the first stroke in all working chambers 10, 11, 12, 13 of a full working cycle of each of said chambers, the crankshaft has completed two full revolutions, the pistons 5, 6 (see FIG. 1 to the left of the axis) occupy their initial position where they were at the very beginning, and the working chambers 10, 11, 12, 13 are again prepared for the completion of the following strokes respectively: Working operation (first stroke) in working chamber 10, compression (fourth stroke) in working chamber 11, inlet (third stroke) in working chamber 12, outlet (second stroke) in working chamber 13. In this situation the working chamber 10 is prepared for the second and the following working cycles, and the working chambers 11, 12, 13 for the completion of the previous cycle.

The supply of fuel mix into the working chambers 10, 11, 12, 13 is carried out at the inlet strokes through inlet openings 14. The removal of exhaust gases from the working chambers 10, 11, 12, 13 is carried out at the outlet strokes through outlet openings 15. In the working operation and compression stroke modes the inlet openings 14 and the outlet openings 15 are closed.

An additional working chamber 45 is formed by one piston. Its height is two times smaller than the height of the working chambers 10, 11, 12, 13. It can be analogously used to increase the output capacity of the piston mechanism used in a type of ICE. The supply of fuel mix into the additional working chamber 45 is carried out at the inlet strokes through an inlet opening 67. The removal of exhaust gases is carried out at the outlet strokes through outlet openings 68. In the working operation and compression stroke modes the inlet openings 67 and the outlet openings 68 are closed. The working mode of the additional working chamber 45 is not linked to the modes of the working chambers 10, 11, 12, 13, therefore its use results in some disruption of the load symmetry in the kinetic scheme of the ICE. Since the capacity of the additional working chamber 45 is two times lower than the capacity of any of the working chambers 10, 11, 12, 13, it does not exert any considerable influence on the dimensions and strength characteristics of the elements of the piston mechanism.

In the proposed piston mechanism, for an effective use of the cylinder cavity on both sides of all pistons except the lowermost, its effective working volume and correspondingly the capacity are increased by 1.9 times, while without considering the additional working chamber the figure is 1.8 times. Its working cycles are displaced in adjacent working chambers by one stroke per phase, thus for every turn of the crankshaft by a half revolution, the working operation is completed in only one of them. As a result, the increase of the number of working chambers in one cylinder up to four does not cause an increase of the momentary load on the crankshaft. Therefore a short crankshaft with three crankpins is used, designed for the force to which it is subjected during the operation of one piston. Consequently, in comparison to the known four-cylinder piston mechanism of analogous capacity, the dimensions of the crankcase are decreased approximately threefold. As a result, for an effective use of the cylinder cavity and for a displacement of phases of the working cycles in the working chambers, the overall volume, and consequently also the weight of the piston mechanism are decreased 2–3 fold.

An additional decrease of the volume and weight of the piston mechanism is caused by a decrease of the height of the pistons and their operation with a corresponding decrease of the revolution radius of the crankpins of the crankshaft as well as the load imparted on them, on the connecting rods and the connecting members. The decrease of the revolution radius of the crankpins of the crankshaft allows an increase of its revolutions. The arrangement of the opposite working cylinder results in a doubling of the capacity of the piston mechanism.

The employment of diverging pistons leads to a redistribution of the work load evenly on the opposite crankpins of the crankshaft with a mutual compensation of the overall load on the bearing assemblies. This increases their lifetime and increases the reliability of the piston mechanism. An increase in efficiency and working reliability of the piston mechanism is caused additionally due to the essentially lessened wear of the sealing rings. The sealing rings attach more tightly to the synchronous connecting rods of their own group of pistons and totally rely only on them due to their own elasticity, depending on their running-in towards the immobile parts of the working surface of the cylinder and towards its movable parts formed by the synchronous connecting rods of the oppositely oriented group of pistons. This results in a deceleration and therefore in a prevention of wear of the sealing rings while their elasticity is almost entirely maintained. Due to the axial symmetry of the load on the pistons and the stability of the position of the sealing rings in the annular grooves the wear of the side walls of said grooves and the sealing rings in the area where they contact these walls is also prevented. Preferably, sealing rings with increased elasticity are employed.

The temperature mode of the synchronous connecting rods does not differ from the temperature mode of the cylinder walls. This allows their placement in long guide channels with a gap of less than 0.02 mm while maintaining the required demands on smooth operation and securing tightness of the working chambers. The described embodiment is to illustrate the essential features of the invention and does not limit the scope of the invention in any way, which is defined by the claims and can be carried out in other embodiments.

The construction of the piston mechanism is carried out in the following order. The crankshaft 7 is arranged in the crankcase 4 of the piston mechanism. Thereafter the bearing assemblies 8 with the bearings 9 are installed, which support the crankshaft 7. On the crankpins 48, 50, 51 of the crankshaft 7 the subsequent construction of the corresponding slide bars 54 and crank-hinge frames 49, 52, 53 is carried out. The sealing rings are arranged on the pistons 5, 6 in their annular grooves 47. The inner connecting member 27 is placed horizontally on the stand 58 of the central crank-hinge frame 49 by a stand 30 on its lower plate 29. The stands 30 and 58 are joined to each other by a pin 63. The connecting rods 19 are arranged in a circle by the securing grips 34 on the lower plate 29 of the inner connecting member 27 in vertical position arranged in the cuts 32 in the upper plate 31. Initially, two connecting rods 19 are arranged. Thereafter all five pistons 5, 6 together with the sealing rings are stacked from the bottom upwards in the required order, one by one. Thereafter the third connecting rod 19 is arranged in the required position. During construction the securing grips 34 of the connecting rods 19 are attached for stability between the lower and the upper plates 29, 31 respectively by bolts 35 with little force. The pistons 5 are distributed by height using gaging inserts so that their annular engaging grooves 46 are positioned on the levels of the corresponding protrusions 25 of the connecting rods 19. The pistons 6 are placed on the pistons 5 positioned underneath. The protrusions 25 are simultaneously inserted to some depth into the annular engaging grooves 46 of the pistons 5 for mutual fastening in the required position, in groups of three on every connecting rod 19 in the sequence of these connecting rods, by applying a predetermined, evenly distributed radial force on the corresponding connecting rod 19. If necessary, a preliminary positioning of the protrusions 25 on the pistons 5 is carried out with weaker bolts 35. The protrusions 25, having been preliminarily fastened to the pistons 5, are arranged in the annular engaging grooves 46 of the pistons 5 to the full depth synchronously and under pressure by simultaneously applying an equal, evenly distributed radial force on all connecting rods 19. Thereafter the position of the securing grips 34 of the connecting rods 19 on the inner connecting member 27 and of the pistons 5 on the protrusions 25 is corrected in accordance with the actual position of the connecting rods 19 in the guide channels 16 by temporarily placing the working cylinder 1 in them at maximum depth. The connecting rods 19 fasten on the inner connecting member 27 by bolts 35 when the working cylinder 1 is placed on them. This fastening of the connecting rods 19 allows to maintain the smoothness of their operation in the guide channels 16 without correcting their position with respect to the other members fastened to them when the working cylinder 1 is moved back and forth many times.

Separately from the piston mechanism, a preliminary construction of the outer connecting member 28 with the connecting rods 20 is carried out. For this, said outer connecting member 28 is positioned horizontally. The connecting rods 20 are arranged in a circle on its lower plate 37 by the securing grips 42 in a vertical position, placed in the cuts 40 of the upper plate 39 so that a channel for the pistons 5, 6 is maintained between their protrusions 26. The securing grips 42 of the connecting rods 20 are fastened between the lower and upper plates 37, 39, respectively, with little force of the bolts 43. The crankshaft 7 is arranged so that its outer crankpins 50, 51 occupy the upper position, and the middle crankpin 48 with the slide bar 54 arranged thereon, the central crank-hinge frame 49 with the inner connecting member 27, the connecting rods 19 and the pistons 5, 6 occupy the lower position. The working cylinder 1 is removed. The outer connecting member 28 assembled with the connecting rods 20 is positioned horizontally on the stands 58 of the lateral crank-hinge frames 52, 53 by diametric stands 38 on its lower plate 37. The inner connecting member 27 passes through its central opening 36 in the process of arranging the outer connecting member. The corresponding stands 38 and 58 are joined to one another by pins 63. With a revolution of the crankshaft 7 the connecting members 27, 28 are placed on one level. By the arrangement of corresponding gage inserts the non-fastened pistons 6 are distributed by height so that their annular engaging grooves 46 are positioned on the level of the corresponding protrusions 26 of the connecting rods 20 of the outer connecting member 28. Analogously with the protrusions 25 of the connecting rods 19, the protrusions 26 are simultaneously inserted to some depth into the annular engaging grooves 46 of the pistons 6 for fastening in the required position, in groups of two on every connecting rod 20 in the sequence of these connecting rods, by applying a predetermined, evenly distributed radial force on the corresponding connecting rod 20. If necessary, a preliminary positioning of the protrusions 26 on the pistons 6 is carried out with weaker bolts 43. The protrusions 26, having been preliminarily fastened to the pistons 6, are arranged in the annular engaging grooves 46 of the pistons 6 to the full depth synchronously and under pressure by simultaneously applying an equal, evenly distributed radial force on all connecting rods 20. Thereafter the position of the securing grips 42 of the connecting rods 20 on the outer connecting member 28 and of the pistons 6 on the protrusions 26 is corrected in accordance with the actual position of the connecting rods 20 in the guide channels 17 by temporarily placing the working cylinder 1 in them at maximum depth. The connecting rods 20 are fastened on the outer connecting member 28 by the bolts 43 when the working cylinder 1 is placed on them. This fastening of the connecting rods 20 allows to maintain the smoothness of their operation in the guide channels 17, simultaneously maintaining the smoothness of the operation of the connecting rods 19 in the guide channels 16, without subsequently correcting the position of the connecting rods 19, 20 with respect to the other members fastened to them when the working cylinder 1 is moved back and forth many times.

The working cylinder 1 is removed and a removable insert 3 is fastened on the crankcase 4 in an appropriate manner. Thereafter, the working cylinder 1 is placed on the connecting rods 19, 20 at the required depth, and by its adjustable lid 2 is fastened on the removable insert 3 in an appropriate manner. A rigid axial displacement of the crank-hinge frames 49, 52, 53 is made possible by corresponding guide plates 64 using regulating bolts 65 for their correct placement. The regulation is carried out at the turn of the crankshaft 7.

When the piston mechanism is provided without the removable insert 3, the adjustable lid 2 of the working cylinder 1 is placed immediately on the crankcase 4. In this embodiment one or more technical apertures are provided in the crankcase 4 of the working cylinder 1 for its construction.

The advantage of said piston mechanism is that the required number of oppositely directed pistons is arranged in the body of one cylinder, forming the corresponding number of working chambers, in which different strokes of independent working cycles are completed simultaneously.

The piston mechanism has an increased dynamic balance and a longer working life with a lessened intensity of wear. It is light, simple, and fast to construct and deconstruct. Its weight is decreased by two to three times, and its price is reduced by one and a half to two times. The use of the proposed piston mechanism with diverging pistons increases the specific capacity by a minimum of 1.8 times.

While the present invention has been illustrated and described with respect to a particular embodiment thereof, it should be appreciated by those of ordinary skill in the art that various modifications to this invention may be made without departing from the spirit and scope of the present invention.

The invention claimed is:

1. A piston mechanism with diverging pistons comprising:

a crankcase with a crankshaft, a cylinder with inlet and outlet openings and at least two pistons of opposite directions of movement, and connecting members interacting with three crankpins of, the crankshaft, wherein one of the connecting members is joined with a middle crankpin and the other is joined with two outer crankpins, wherein at least one piston is firmly attached to connecting rods, which are rigidly fastened to one of the connecting members by their bases and are positioned in guide channels provided in the cylinder parallel to its axis, forming a synchronous group of connecting rods with a direction of movement corresponding to said connecting member, characterized in that the cylinder additionally comprises connecting rods which are firmly attached to at least one of pistons of opposite direction of movement, and by their bases are attached to the other connecting member, and are positioned in additional guide channels formed in the body of the cylinder parallel to abovementioned guide channels in alternating sequence with them, forming another synchronous group of connecting rods with a direction of movement corresponding to the other connecting member, wherein all guide channels are provided with through-cuts in the working surface of the cylinder with outlets into its cavity so that lateral faces of the connecting rods of the synchronous groups of the different directions facing the cavity of the cylinder form movable parts of its working surface, wherein the pistons are sequentially attached by their peripheries to the lateral faces of the connecting rods of the different synchronous groups, forming working chambers between them.

2. The piston mechanism according to claim 1, wherein the connecting members are disposed between the crankshaft and the piston adjacent to it.

3. The piston mechanism according to claim 2, wherein the connecting members have the form of an inner and an outer connecting member having central opening for free movement within one another so that the outline of the inner connecting member repeats the outline of the central opening of the outer connecting member.

4. The piston mechanism according to claim 3, wherein the inner connecting member has the form of two plates joined to one another, a lower plate with a stand and an upper plate with radial cuts around the periphery for the connecting rod of the synchronous group of this connecting member, attached to the lower plate by their bases, and with recesses between the connecting rods in both plates for the connecting rods of the other synchronous group.

5. The piston mechanism according to claim 4, wherein the inner connecting member is joined with a middle crankpin of the crankshaft.

6. The piston mechanism according to claim 5, wherein the inner connecting member is joined with the middle crankpin of the crankshaft through a central crank-hinge frame.

7. The piston mechanism according to claim 6, wherein the central and lateral crank-hinge frames each have the form of a separable rectangular outline and a slide bar arranged within the outline for free translational movement engaging with the corresponding crankpin of the crankshaft.

8. The piston mechanism according to claim 6, wherein the central crank-hinge frame has the stand joined with the stand of the inner connecting member via a pin.

9. The piston mechanism according to claim 8, wherein the central and lateral crank-hinge frames are disposed between the guide plates arranged in the crankcase.

10. The piston mechanism according to claim 5, wherein the inner connecting member is joined with the middle crankpin of the crankshaft via a central link.

11. The piston mechanism according to claim 10, wherein the central link is joined with the stand of the inner connecting member via a pin.

12. The piston mechanism according to claim 3, wherein the outer connecting member has the form of two multifaceted plates, having central openings, rounded to an oval at their tops and attached to one another, the lower plate having two diametric stands and the upper plate having radial cuts around the outline of the central opening for the connecting rods of the synchronous group of this connecting member attached to the lower plate by their bases and with recesses between the connecting rods in both plates for the connecting rods of the other synchronous group.

13. The piston mechanism according to claim 12, wherein the outer connecting member is joined with two outer crankpins of the crankshaft.

14. The piston mechanism according to claim 13, wherein the outer connecting member is joined to the outer crankpins of the crankshaft through lateral crank-hinge frames.

15. The piston mechanism according to claim 14, wherein each of the lateral crank-hinge frames has the stand joined with the corresponding stand of the outer connecting member via a pin.

16. The piston mechanism according to claim 13, wherein the outer connecting member is joined with the outer crankpins of the crankshaft through lateral links.

17. The piston mechanism according to claim 16, wherein each of the lateral links is joined with the corresponding stand of the outer connecting member via a pin.

18. The piston mechanism according to claim 3, wherein three protrusions for attaching the pistons of one direction of movement are formed on the lateral faces of the connecting rods of the synchronous group of the inner connecting member facing the cavity of the cylinder.

19. The piston mechanism according to claim 18, wherein the protrusions on the connecting rods of the synchronous group of the outer connecting member are arranged between the protrusions on the connecting rods of the synchronous group of the inner connecting member.

20. The piston mechanism according to claim 18, wherein the protrusions on the connecting rods of one synchronous group are provided at equal distance to one another which is equal to the distance between the protrusions on the connecting rods of the other synchronous group.

21. The piston mechanism according to claim 18, wherein the protrusions on the connecting rods of both synchronous group have increased area of their cross section.

22. The piston mechanism according to claim 18, wherein the pistons are provided with annular engaging grooves for the protrusions of the connecting rods of the synchronous groups.

23. The piston mechanism according to claim 18, wherein the pistons are additionally attached to the protrusions of the connecting rods of both synchronous groups by bolts.

24. The piston mechanism according to claim 3, wherein two protrusions for attaching the pistons of the opposite direction of movement are formed on the lateral faces of the connecting rods of the synchronous group of the outer connecting member facing the cavity of the cylinder.

25. The piston mechanism according to claim 1, wherein the connecting rods of both synchronous group are arranged with wide faces and shoulders for the guide channels are arranged on the wide faces of the connected rods from the side of their lateral faces which are furthest away from the axis of the cylinder.

26. The piston mechanism according to claim 25, wherein the shoulders are continuous.

27. The piston mechanism according to claim 25, wherein the shoulders are interrupted.

28. The piston mechanism according to claim 25, wherein the width of the wide faces of the connecting rods of both synchronous groups exceeds the thickness of these connecting rods more than twofold in radial direction without considering the shoulders.

29. The piston mechanism according to claim 1, wherein the cross section of the connecting rods corresponds to the cross section of the guide channels.

30. The piston mechanism according to claim 1, wherein the connecting rods are arranged in the guide channels with a gap of less than 0.02 mm.

31. The piston mechanism according to claim 1, wherein the pistons are provided with annular grooves for sealing rings.

32. The piston mechanism according to claim 1, wherein the guide channels for the connecting rods of both synchronous groups cover the entire length of the working cylinder.

33. The piston mechanism according to claim 1, wherein the guide channels have a T-shaped cross section profile.

34. The piston mechanism according to claim 1, wherein the guide channels for the connecting rods of the different synchronous groups alternate with each other by one channel.

35. The piston mechanism according to claim 1, wherein the guide channels for the connecting rods of the different synchronous groups alternate with each other by two channels.

36. The piston mechanism according to claim 1, wherein the guide channels are formed in the cylinder at equal distances from one another.

37. The piston mechanism according to claim 1, wherein the through-cuts in the guide channels cover their entire length.

38. The piston mechanism according to claim 1, wherein the inlet and outlet openings are located in the middle sections of the working chambers formed by two diverging pistons.

39. The piston mechanism according to claim 38, wherein the working chambers are formed by diverging pistons and are equal in height.

40. The piston mechanism according to claim 1, wherein an additional working chamber formed by one outer piston is two times smaller in height than the working chambers formed by the diverging pistons.

41. The piston mechanism according to claim 1, wherein the inlet and outlet openings are arranged in the upper part of the additional working chamber formed by one outer piston.

42. The piston mechanism according to claim 1, wherein the inlet and outlet openings are formed in spaces between guide channels.

43. The piston mechanism according to claim 1, wherein the cylinder is provided with an adjustable lid arranged on the crankcase.

44. The piston mechanism according to claim 1, wherein the crankcase comprises technical apertures.

45. The piston mechanism according to claim 1, wherein the cylinder is provided with a lid.

46. The piston mechanism according to claim 1, wherein the cylinder is provided with spark plugs in the working chambers.

* * * * *